United States Patent [19]

Lai

[11] Patent Number: 4,618,087

[45] Date of Patent: Oct. 21, 1986

[54] HIGH IMPACT FORCE STAPLING MACHINE WITH REBOUNDED IMPACT FORCE DAMPING

[76] Inventor: Wen T. Lai, No. 11, Ya Hsiu Rd., Ta Ya Hsiang, Taichung Hsien, Taiwan

[21] Appl. No.: 743,813

[22] Filed: Jun. 12, 1985

[51] Int. Cl.[4] ..... B25C 1/06; B25C 5/15

[52] U.S. Cl. ..... 227/131; 227/156; 173/139

[58] Field of Search ..... 227/131; 173/117, 139; 81/27

[56] References Cited

U.S. PATENT DOCUMENTS

| | | | |
|---|---|---|---|
| 3,347,441 | 10/1967 | Doherty | 227/131 |
| 3,434,026 | 3/1969 | Doyle | 227/131 X |
| 4,006,763 | 2/1977 | Ordonez | 81/27 |
| 4,500,936 | 2/1985 | Dunlin | 227/131 X |

FOREIGN PATENT DOCUMENTS

| | | | |
|---|---|---|---|
| 1281970 | 10/1968 | Fed. Rep. of Germany | 173/139 |
| 2330958 | 1/1974 | Fed. Rep. of Germany | 227/131 |
| 52-8579 | 1/1977 | Japan | 227/131 |
| 2123625 | 2/1984 | United Kingdom | 227/131 |

*Primary Examiner*—Robert L. Spruill
*Assistant Examiner*—Taylor J. Ross
*Attorney, Agent, or Firm*—Browdy & Neimark

[57] ABSTRACT

A stapling machine with an increased momentum of the driver-ram combination for a heavy-duty task, the ram being accelerated by means of two electrical coils which surround externally the path of the ram to produce magnetic forces to speed up the movement of the ram. The rebound of the drive-ram combination is slowed down by means of an absorbing device which consists of many heavy-weight metal particles confined in a hollow round bar forming the ram, which particles move along but lag behind the movement of the ram so that the ram, when it rebounds will move against the particles still moving forward thereby dissipating ram momentum to prevent bouncing-back movement of the ram.

2 Claims, 4 Drawing Figures

HIGH IMPACT FORCE STAPLING MACHINE WITH REBOUNDED IMPACT FORCE DAMPING

FIELD OF THE INVENTION

The present invention is an improved stapling machine used for heavy-duty tasks with a more powerful driver and an absorbing device which can sponge up or absorb most of the impact force of the rebounding driver after hitting a target.

SUMMARY OF THE INVENTION

It is an object of the present invention to produce a heavy-duty stapler which not only has a more powerful impact capability but also can absorb he impact force of the rebounding ram.

By means of two or more electromagnetic coils which encircle the driver and are connected electrically in series, the ram can be accelerated consecutively by magnetic forces produced in each electromagnetic coil.

The electromagnetic coils are controlled by an electronic circuit which is responsible for proper timing to create a magnetic force in a second coil first by starting an electric current in it, then establishing a magnetic force the same way in a first coil sequentially, instantly upon the ram reaching the first coil. The driver can gain a considerable momentum after these two stages to provide a powerful strike on any target.

Numerous tiny heavy-weight metal particles, confined to an interior compartment inside the ram and moving along with the accelerated ram before it strikes the target, can serve as an absorbing device when those tiny metal particles moving with inertia hit against the end of the rebounding ram. The slowing down of the rebounding ram will guarantee a stable, steady and powerful striking force.

DETAILED DESCRIPTION OF THE PREFERRED EMBODIMENT

There can be two or more electromagnetic coils, depending on the magnitude of impact force required, which are used to produce magnetic forces accelerating a ram to which is connected an impact rod responsible for hitting the staples.

Figure 4:
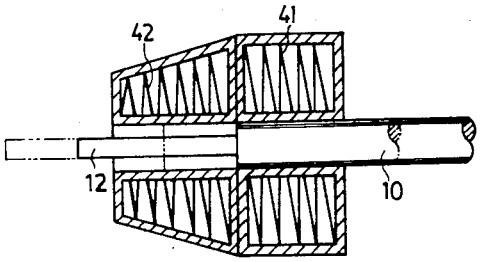
FIG. 4 is a sectional view of the two compartments of the coils.
Figure 1:
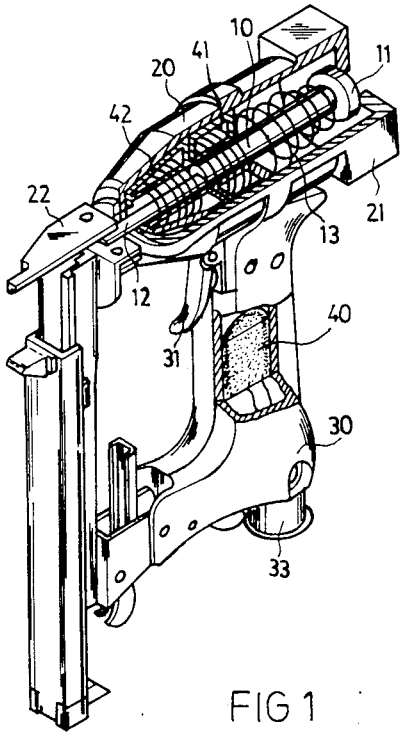
FIG. 1 is a perspective and sectional view of the assembled stapler.

Referring to FIG. 1 and FIG. 4, inside the case of stapler 20, there is a firing base made up of a round bar which is ram 20 and a circular flange 11 at the end of the bar, and integrally connected to the other end is a slender flat impact rod for driver 12. Confined in an interior compartment 102 of the hollowed ram 10 are a plentiful supply of small heavy-weight metal particles 101 serving as an absorber by using their mass of inertia.

Divided into two sections, the case 20 of the stapler has a front compartment and a rear compartment. In the rear compartment, a spring 13 is located between circular flange 11 and the forward wall of the rear compartment to give a return force for the ram.

Two electromagnetic coils 41 and 42 are placed in two adjoining compartments, pierced through by a channel. The ram and the driver are accelerated by the two-stage coils, consecutively, and move along in the channel to drive the preset staples into the objects effectively.

Inside the handle 30 there is located a circuit board 40 with one point connected to a plug seat 33 by electric wiring and with another point connected to coils 41, 42, so as to initiate an electrical circuit and in the meanwhile actuate coils 41, 42 to establish magnetic forces accelerating ram 10 and also driver 2 by simply pressing trigger 31.

Figure 2:
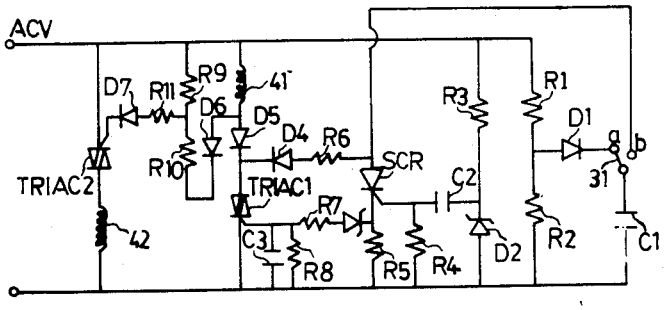
FIG. 2 is a circuit diagram of the electric circuit of the present invention.

Referring to FIG. 2, the electrical circuit consists primarily of an SCR (silicon controlled rectifier), TRIAC's 1 and 2 (gate controlled full wave alternating current silicon switches) connected in parallel or series with load resistors (R), capacitors (C), diodes (D), Zener diodes (1). After an alternating power supply of 110 V, 60 HZ or 220 V, 60 HZ is connected to plug seat 33, with the trigger 31 contacting point "a", the voltage of the power supply is dropped through load resistors R1, R2. The rectified electric current through diode D1 begins to charge capacitor C1, and the charging process will cease after a pre-set period of time. On the other hand, an approximately rectangular signal wave is transmitted between the resistor R3 and Zener diode D2, and this signal passes through the RC network, comprising resistor R4 and capacitor C2, creating a pulse signal across resistor R4 which is used to actuate the SCR (frequency 60 HZ). On pressing the trigger to connect another circuit at point "b", the electrical charges on capacitor C1 immediately are released to the SCR. In the meanwhile, the said pulse signal across resistor R4 is activating the SCR. With the above-said procedure taking place, there establishes an electrical potential across resistor R5 which makes TRIAC 1 function allowing only positive half wave passing through TRIAC 1, initiating a magnetic field in coil 41 which is responsible for the first-stage acceleration of ram 10 as well as driver 12.

The trigger being released returns to its original position in contact with point "a" by means of a spring. On the point of the shift of the alternating electrical voltage from positive to negative pulse, the TRIAC 1 immediately ceases functioning and a counter voltage is induced on coil 41 at the same time which establishes a forward bias voltage for actuation of TRIAC 2. The actuated TRIAC 2 causes coil 42 to provide the second stage magnetic force for further accelerating ram 10 as well as driver 12 to magnify the momentum of ram-driver combination for a more powerful and effective striking of the staples (as indicated in FIG. 4 marked by the dotted line).

The diode D4 and resistor R6 are responsible for quickly dissipating all the electric charges in the circuit consisting of D4, R6 and TRIAC 1 upon the starting of TRIAC 1 owing to the electrical voltage created on capacitor C1, in such a way that the SCR can be blocked to take the electrical charges from the next positive half pulse of alternating voltage, so as to prevent TRIAC 1 from being actuated by not offering adequate electrical potential across resistor R5. This step can prevent a magnetic force in coil 41, owing to the alternating voltage, so as not to slow down the accelerated ram-driver combination at the second stage. The magnetic force in coil 41 can by reversing action slow down the ram-driver combination by creating a drag on the rear half of the ram with its mass center passing through the geometric center of coil 41, so it is necessary to stop the establishment of a magnetic field at this time. The magnetic field can also be stopped at the point of the shift of the alternating voltage from negative to positive pulse, leading to the stopping of the actuating of TRIAC 2. According to the theory used above, the stapler can gain even more powerful momentum by using more coils.

Figure 3:
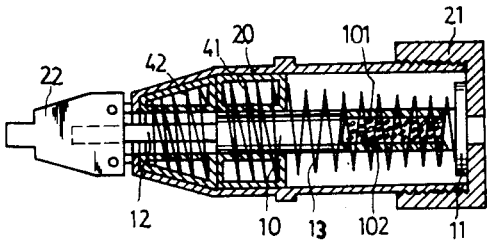
FIG. 3 is a sectional view of the hitting head of the stapler.

Referring to FIG. 3, ram 10 accelerated by coils 41 and 42 moves forward to hit an object and in the meantime compresses a return spring 13 by means of its rear flange 11. The compressed spring 13 tends to return the ram-driver combination to its original position after the driver hits the target. Before the driver 12 hits a target, the many tiny metal particles confined in interior compartment 102 of ram 10 move along with ram 10, but lag just a little behind the movement of the ram, so a rebounding ram will move against those particles 101 still moving forward and in this manner a considerable momentum will be dissipated to prevent a bouncing-back movement of the ram.

All of the above said motions take place in almost no time (the average hitting time is 1/360 second). The rebounding ram can be so decelerated by the heavy-weight metal particles 101 that it will avoid repeatedly bouncing back and forth, which bouncing causes imperfect striking on objects. So the present invention is particularly characterized by its methods of increasing momentum on the ram-driver combination and the momentum-absorbing device which makes the stapler operate more effectively than conventional staples.

I claim:

1. An improved stapler with increased momentum for better hitting capability and better absorption of the rebound momentum comprising a casing for the stapler;

a ram-driver combination mounted for reciprocal movement in said casing in a forward reciprocal movement followed by a rebounding reciprocal movement;

at least two electromagnetic coils coaxially aligned along an axis of the reciprocal movement of said ram-driver combination externally of said ram driver combination;

electrical circuit means connected to said coils to control current to said electromagnetic coils to produce a magnetic field with said coils and consecutively activate said coils to accelerate said ram-driver combination to obtain maximum hitting momentum at the end of the forward reciprocal movement of said ram-driver;

said ram-driver combination including a ram and a driver;

said ram including a hollow round bar having a flange on one end;

said driver including a flat impact rod integrally connected to a front end of said ram;

means to slow down said ram during the rebounding reciprocal movement by absorption of momentum including heavy-weight metal particles of a predetermined amount confined inside said hollow round bar and adapted for forward movement with the forward reciprocal movement of said ram but lagging behind said movement of said ram by force of inertia and causing said ram on the rebounding reciprocal movement to move against the forward moving particles whereby collisions of said particles will absorb the momentum of said ram-driver combination during the rebounding reciprocal movement.

2. The improved stapler of claim 1, further comprising a trigger operated switching means connected to switch said electrical circuit means;

said electrical circuit means including a silicon controlled rectifier electrically connected to said switching means, resistors, diodes, and Zener diodes electrically connected with a pair of triacs, said silicon controlled rectifier electrically connected to actuate said triacs when a trigger on said trigger operated switching means is pressed and released to allow current to said coils to create a magnetic field with said coils to accelerate said ram.

* * * * *